US011319823B2

(12) United States Patent
Schroder et al.

(10) Patent No.: US 11,319,823 B2
(45) Date of Patent: May 3, 2022

(54) ROTOR WITH SEALING ELEMENT AND RING SEAL

(71) Applicant: Siemens Energy Global GmbH & Co. KG, Munich (DE)

(72) Inventors: Peter Schroder, Essen (DE); Karsten Kolk, Mülheim a.d. Ruhr (DE); Peter Kury, Essen (DE); Dirk Springborn, Berlin (DE); Kevin Kampka, Mülheim a.d. Ruhr (DE); Christopher W. Ross, Oviedo, FL (US); Yulia Bagaeva, Leningradskaya obl. (RU)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 16/957,223

(22) PCT Filed: Jan. 7, 2019

(86) PCT No.: PCT/EP2019/050247
§ 371 (c)(1),
(2) Date: Jun. 23, 2020

(87) PCT Pub. No.: WO2019/149474
PCT Pub. Date: Aug. 8, 2019

(65) Prior Publication Data

US 2020/0392857 A1 Dec. 17, 2020

Related U.S. Application Data

(60) Provisional application No. 62/642,126, filed on Mar. 13, 2018.

(30) Foreign Application Priority Data

Feb. 2, 2018 (EP) ..... 18154881

(51) Int. Cl.
*F01D 11/00* (2006.01)
*F01D 5/30* (2006.01)
*F01D 5/02* (2006.01)

(52) U.S. Cl.
CPC ..... *F01D 11/006* (2013.01); *F01D 5/025* (2013.01); *F01D 5/3015* (2013.01);
(Continued)

(58) Field of Classification Search
CPC ..... F01D 5/3015; F01D 11/006
(Continued)

(56) References Cited

U.S. PATENT DOCUMENTS 3,137,478 A * 6/1964 Farrell ..... F01D 11/006 416/220 R
4,507,052 A 3/1985 Thompson
(Continued)

FOREIGN PATENT DOCUMENTS

DE 102016208759 A1 11/2017
EP 2453150 A1 5/2012
(Continued)

OTHER PUBLICATIONS

PCT International Search Report and Written Opinion of International Searching Authority dated Dec. 4, 2019 corresponding to PCT International Application No. PCT/EP2019/050247 filed Jul. 1, 2019.

*Primary Examiner* — Topaz L. Ellioitt

(57) ABSTRACT

A sealing element and a rotor of a gas turbine having at least one rotor disc and having an annular rotor component arranged adjacently to the rotor disc and having a plurality of sealing elements arranged distributed around the circumference. The sealing elements are fastened to the rotor disc at least in the axial direction. An inner edge portion of each of the sealing elements is adjacent to a sealing portion of the
(Continued)

rotor component. In order to provide a seal between the sealing element and rotor component whilst at the same time enabling a relative axial displacement, a ring seal is arranged in a receiving space formed by the sealing element and rotor component.

17 Claims, 3 Drawing Sheets

(52) U.S. Cl.
CPC ..... *F01D 5/3007* (2013.01); *F05D 2220/32* (2013.01); *F05D 2240/24* (2013.01); *F05D 2240/55* (2013.01); *F05D 2260/30* (2013.01)

(58) Field of Classification Search
USPC ..... 416/220 R
See application file for complete search history.

(56) References Cited

U.S. PATENT DOCUMENTS

| | | | | | |
|---|---|---|---|---|---|
| 4,767,276 | A * | 8/1988 | Barnes | F01D 5/3015 | 416/220 R |
| 5,169,289 | A * | 12/1992 | Lalanne | F01D 5/3015 | 416/220 R |
| 5,211,407 | A * | 5/1993 | Glynn | F01D 11/006 | 277/632 |
| 6,494,684 | B1 * | 12/2002 | Wagner | F01D 5/3015 | 403/278 |
| 2009/0116965 | A1 | 5/2009 | Brillert et al. | | |
| 2012/0112415 | A1 | 5/2012 | Benjamin et al. | | |
| 2013/0004319 | A1 | 1/2013 | Lee et al. | | |
| 2013/0272886 | A1 | 10/2013 | Dimmick et al. | | |
| 2015/0361813 | A1 * | 12/2015 | Bricaud | F01D 5/3007 | 416/220 R |
| 2016/0040542 | A1 * | 2/2016 | Weise | F01D 11/02 | 416/220 R |
| 2016/0090854 | A1 * | 3/2016 | Webb | F01D 5/3015 | 416/220 R |
| 2016/0273370 | A1 * | 9/2016 | Belshaw | F01D 25/12 | |
| 2017/0292396 | A1 * | 10/2017 | Matthews | F01D 5/02 | |
| 2018/0023401 | A1 | 1/2018 | Hoell et al. | | |

FOREIGN PATENT DOCUMENTS

| | | | | |
|---|---|---|---|---|
| EP | 2514923 | A1 * | 10/2012 | F01D 5/323 |
| EP | 2653660 | A1 | 10/2013 | |
| EP | 3061916 | A1 | 8/2016 | |
| JP | 2013015137 | A | 1/2013 | |
| WO | 2007028703 | A1 | 3/2007 | |

* cited by examiner

ROTOR WITH SEALING ELEMENT AND RING SEAL

CROSS REFERENCE TO RELATED APPLICATIONS

This application is the US National Stage of International Application No. PCT/EP2019/050247 filed 7 Jan. 2019, and claims the benefit thereof. The International Application claims the benefit of European Application No. EP18154881 filed 2 Feb. 2018 and of U.S. Provisional Application No. 62/642,126 filed 13 Mar. 2018. All of the applications are incorporated by reference herein in their entirety.

FIELD OF INVENTION

The invention relates to a sealing element for use in a rotor having a rotor disc to which a plurality of rotor blades can be attached distributed around the circumference. A plurality of sealing elements is arranged on a front side of the rotor disc in this case, by means of which a cover is provided for the blade retaining grooves necessary for receiving the rotor blades.

BACKGROUND OF INVENTION

Different kinds of rotors which have a rotor disc with rotor blades and sealing plates are known from the prior art. In this case, the rotor disc has rotor blade retaining grooves distributed around the circumference, in each of which a rotor blade with a blade foot is fastened. The rotor blades have a blade platform radially on the outside of the rotor disc which extends in the circumferential direction as far as the following blade platform in each case. On one or both front sides of the rotor blade are located sealing plates for covering the rotor blade retaining grooves, which sealing plates are particularly intended to bring about a separation between a hot gas flowing along the rotor and a cooling air flowing in the inside of the rotor blades.

For this purpose, the sealing plates are mounted in a known manner in an internal ring groove on the rotor disc and in an outer ring groove formed by the rotor blades. The function of the bearing of the sealing plate in the ring groove is, in particular, to seal the region between the sealing plate and the rotor disc separately from a region on the opposite side of the sealing plate.

Furthermore, embodiments are known in the art in which the sealing plates are furthermore fastened to the rotor disc by means of a hook portion. In this case, the rotor disc has corresponding hooking means which match one another between the blade retaining grooves and the sealing plates. This improves the axial fixing of the sealing plates on the rotor disc.

The disadvantage of this inherently advantageous fastening of the sealing plates is the necessary arrangement of the ring groove in the rotor disc with the hooking means, so that the axial position both of the ring groove and of the hooking means is fixed. This is the only way in which problem-free assembly can be guaranteed and bending stresses in the sealing plate avoided during the installation thereof on the rotor disc. This disadvantage emerges particularly during production of the rotor disc using the necessary processing steps to realize the hooking means and the ring groove.

This leads on to the next requirement for the necessary provision of a seal between the sealing plate in the region of the ring groove, in order to prevent a loss of cooling air. For this purpose, it is firstly provided that the sealing plates are fixed to the rotor disc with an inner edge portion and an advantageous seal is thereby simultaneously created by the engagement of the inner edge portion with the ring groove. To the extent that the sealing elements are mounted with the inner edge portion in ring grooves in the rotor, excess pressure between the rotor disc and the sealing plate usually leads to a pressing of the inner edge portion of the sealing plate against an edge of the ring groove pointing away from the rotor disc.

However, if axial displaceability of the sealing plates on the inner edge portion is required, because thermal expansions lead to the displacement of the ring groove, for example, or the ring groove is arranged in an adjacent component, the solutions previously referred to cannot be used.

SUMMARY OF INVENTION

The problem addressed by the present invention is therefore that of allowing the axial fixing of the sealing plates to the rotor disc spaced apart from an inner edge portion, without axial fixing to the inner edge portion being necessary.

The problem posed is solved by an embodiment of a sealing element and of a rotor according to the invention as claimed. Advantageous embodiments are the subject matter of the dependent claims.

A second embodiment of a rotor according to the invention is also described and claimed.

The generic sealing element is properly intended for use with a rotor. The type of rotor involved here is unimportant to begin with, whereas the sealing element is particularly used on a gas turbine. Irrespective of this, the embodiment may be likewise used for other kinds of rotors, for example a steam turbine. The design of the rotor is initially unimportant to the assignment of the sealing element. It at least needs to be relevant to a rotor shaft and to one side or to another side. For this purpose, the designated rotor comprises a rotor disc and defines a rotor shaft.

The sealing element forms part of a ring-shaped disc and, to this extent, at least sectionally a portion of a rotational body. The sealing element in this case extends substantially in the circumferential direction and in the radial direction, while the axial extent is smaller by comparison. In this case, the sealing element forms an inner edge portion on the side pointing to the rotor shaft and an outer edge portion on the radially outwardly pointing side. The side pointing to the rotor disc in the designated installation position is defined below as the inside of the sealing element and the opposite side pointing away from the rotor disc as the outside.

The sealing element has on the inside a retaining projection elevated in the axial direction, i.e. in the direction of the rotor shaft. This projection is used as intended in order to fasten the sealing element to the rotor disc. The retaining projection in this case is arranged between the inner edge portion and the outer edge portion. In this case it is initially unimportant whether only one retaining projection, or multiple retaining projections, is/are arranged on the sealing element. It is also initially unimportant whether a retaining projection is connected to a fastening projection or a retaining projection to two fastening projections and/or two retaining projections to a fastening projection. What is crucial is the anticipated axial fixing of the sealing element to the rotor disc through the connection of the retaining projection and fastening projection.

When the sealing element is regarded as part of a ring-shaped disc or the extent "at least" in the circumferential direction and in the radial direction, the retaining projection is disregarded accordingly. Furthermore, it may be provided that the sealing element has further geometries such as ribs, for example, which are not presented as part of a rotational body.

As a further feature of a generic sealing element, said sealing element has a conical circumferential surface on the underside pointing to the rotor shaft. In line with the fact that the sealing element is a segment in the circumference around the rotor shaft, viewed more accurately, the circumferential area is a portion of a conical rotational area delimited in the circumferential direction.

In the case of sealing plate designs having a conical underside, as known in the art, this is either used exclusively to save on material or for weight reduction or it results from limited installation space. In all cases known in the art, there is no further function for the underside or the conical circumferential surface.

By contrast, it is provided according to the invention that the orientation of the conical underside against the customary sealing plates is reversed in the case of the sealing element and thereby performs the function of a sealing surface. By analogy, this results in the distance between the sealing surface and the rotor shaft being smaller from the outside to the inside.

It is otherwise customary in the prior art for the seal on the inner edge portion of the sealing element to be effected through a bearing of the outside of the inner edge portion against an edge of the ring groove. By contrast, it is provided here that the seal is created on the underside of the sealing element, i.e. on the sealing surface which is now present. This releases any compulsion for the inner edge portion to be fixedly mounted axially in a ring groove.

Furthermore, the execution of a rotor according to the invention is made possible with the sealing element according to the invention.

The generic rotor has at least one rotor disc for this purpose—as previously described—which is arranged distributed around the outer circumference and has a plurality of blade retaining grooves. The blade retaining grooves in this case run in an axial direction parallel to the rotor shaft or in a direction inclined hereto or they have an arcuate profile, advantageously in the axial direction. The blade retaining grooves are each intended to receive rotor blades.

The rotor disc in this case comprises a plurality of fastening projections arranged distributed over the circumference, which fastening projections extend axially from a front side of the rotor disc. The fastening projections in this case are each arranged between adjacent blade retaining grooves.

Furthermore, the generic embodiment of the rotor comprises a plurality of sealing elements arranged distributed around the circumference which cover the blade retaining grooves at least sectionally in front of a front side of the rotor disc. In order to fasten the sealing elements to the rotor disc, it is provided at least in an axial direction that the sealing elements have retaining projections extending axially to the front side. The retaining projections in this case are fastened to the fastening projections, so that at least one axial fixing takes place.

According to the invention, sealing elements are used as previously described which exhibit a sealing surface on the underside facing the rotor shaft.

An advantageous rotor furthermore has a plurality of rotor blades which are arranged on the rotor disc distributed around the circumference. In this case, the rotor blades are each fastened with a blade root in the corresponding blade retaining grooves. The rotor blades in this case each have a blade platform adjacent to the blade root, which blade platform covers the rotor disc sectionally and extends beyond a front side of the rotor disc in this case. A paddle is located extending radially outwards on the blade platform. The design of the rotor blades is of no substantial relevance to the invention and will probably be known to the person skilled in the art from the state of the art.

It is particularly advantageous in this case for a ring segment groove opening to the rotor shaft to be arranged in the blade platform in a portion projecting beyond the front side. In this case, it is provided that the sealing element is received in the ring segment groove with an outer, radially outwardly pointing edge portion. In this way, an axial coupling between the rotor blade, the sealing element and, through the fixing thereof to the rotor disc, an axial coupling between the rotor blade and the rotor disc is achieved.

Various embodiments are available for the axial connection of the retaining projection and fastening projection, wherein in a first advantageous embodiment the retaining projection is created in the form of a hook extending to the rotor shaft. For this purpose it is necessary for the rotor disc to have a fastening projection in the form of a radially outwardly extending hook. The axial fixing is achieved through the interlocking of the fastening projection and the retaining projection. This embodiment favors a particularly simple assembly of the sealing element with a sliding onto the rotor shaft.

In an alternative embodiment, it is likewise possible for the retaining projection to be created in the form of a radially outwardly extending hook. Accordingly, it is necessary for the fastening projection on the rotor disc to take the shape of a hook extending to the rotor shaft. Similarly, an axial fixing is made possible through the interlocking of the fastening projection and the retaining projection.

Furthermore, the two embodiments can be combined in that the retaining projection or the fastening projection has a T-shaped profile which is enclosed by a conventional C-shaped fastening projection or retaining projection. Similarly, a design in the form of a dovetail connection can be selected.

The stable fastening of the sealing element to the rotor disc, particularly in the connection of the retaining projection on the fastening projection, is favored when the two edges of the sealing element are located in the region between the two blade retaining grooves in the circumferential direction. This allows the hooking of the retaining projection to two adjacent fastening projections spaced apart by an intermediate blade retaining groove. Likewise, it is possible in this case for two retaining projections spaced apart in the circumferential direction to be provided on a sealing element.

A radial fixing of the sealing plate can take place in different ways, wherein in a first simple and advantageous embodiment a bearing of the outer edge portion with a radially inwardly pointing bearing surface on the blade platform, i.e. advantageously on the groove base of the ring segment groove, is provided. To this extent, centrifugal forces are transmitted by the sealing element initially to the blade platform.

With an embodiment of the hook portion of the retaining projection and the fastening projection having a fastening projection pointing to the rotor shaft or the combination of a C-shaped and T-shaped retaining/fastening projection, it is alternatively advantageously possible for centrifugal forces to be transmitted from the sealing element straight to the rotor disc via the connection of the retaining projection on the fastening projection.

For assembly with this embodiment, it is on the one hand possible for a bayonet-like fastening to be provided in which the sealing element is initially positioned in such a manner that the retaining projection is located alongside the fastening projection in the circumferential direction and the interlocking of the fastening projection and retaining projection is then brought about by a relative displacement in the circumferential direction.

When the sealing element is supported via the outer edge portion on the blade platform, it is furthermore possible for the sealing element to be mounted radially inwardly and following a displacement in the circumferential direction—with the opening of a blade retaining groove—for the rotor blade to be inserted and the sealing elements consequently moved back into their target position.

On the other hand—insofar as the available space allows radial play—it is furthermore possible for assembly of the sealing element to be provided with a radially outwardly pointing movement. In this case, it is necessary for there to be sufficient free space on the rotor disc next to the inner edge portion in the installation position, so that the sealing element is initially arranged with the inner edge portion in the free space and consequently, with a radially outwardly pointing movement with simultaneous tilting of the sealing element, a mating of the retaining projection with the fastening projection and, advantageously, a bearing of the outer edge portion on the blade platform takes place.

Irrespective of the type of assembly, it is advantageous in each case for a displacement of the sealing element in the circumferential direction relative to the rotor disc to be prevented while the rotor is in use. Accordingly, it is advantageous for the sealing element to be secured on the rotor disc and/or the rotor blade in the circumferential direction by means of a securing element.

In a particularly advantageous embodiment, a sealing ring is arranged on the sealing surface on the side pointing to the rotor shaft, said sealing ring being adjacent to the sealing surface, at least during rotation of the rotor. Although it is possible for the sealing ring to have a multipart configuration, it is particularly advantageous for said sealing ring to be configured in the manner of a piston ring. In order to allow assembly of the rotor, in particular to be able to replace the sealing ring during maintenance work, it may furthermore be provided that said sealing ring has a two-part design.

In a particularly advantageous embodiment, the sealing ring lies flat against the sealing surfaces of the sealing elements and therefore has a likewise conical design on the radially outwardly pointing side. Alternatively, it is possible for this purpose for the sealing ring to have a spherical design on the radially outwardly pointing side, so that irrespective of the axial position of the sealing ring on the conical sealing surface, there is a circumferential bearing.

The solution according to the invention should allow the sealing element to be axially displaceable relative to the sealing ring. For this purpose it is advantageous for the surfaces abutting one another not to be the same width in the axial direction. For this purpose, it may be provided in a first advantageous embodiment that the width of the sealing surface on the sealing element viewed in the axial direction is between 0.6 times and 0.9 times the width of the sealing ring. Particularly advantageous in this case is a ratio of the width of the sealing surface in the axial direction to the width of the sealing ring to be between 0.7 and 0.8. In a second advantageous embodiment, the sealing surface is wider in design than the sealing ring. In this case, the advantageous width of the sealing ring is between 0.6 times and 0.9 times the width of the sealing surface in the axial direction. Similarly, a width of the sealing ring between 0.7 times and 0.8 times the width of the sealing surface viewed in the axial direction is particularly advantageous.

The reliable position of the sealing ring below the sealing surface is ensured when the sealing ring is able to be reliably supported on the inner edge portion of the sealing element when centrifugal forces occur. If the cross section is observed through the sealing ring, the center of the area in each specified state of the rotor is located radially beneath the inner edge portion, i.e. beneath the sealing surface, so that the centrifugal force of the sealing ring which occurs is directly supported on the inner edge portion without additional bending moments and shear forces occurring in the sealing ring. The possible axial positional changes of the sealing ring relative to the sealing element must be taken into account for this purpose.

In order to guarantee the position of the sealing ring, the rotor advantageously has a ring surface around the rotor shaft, wherein the sealing ring is arranged radially outside the ring surface. Accordingly, the position of the sealing ring on the side of the ring surface facing the rotor shaft is delimited by the ring surface.

Furthermore, the rotor advantageously has a sealing edge. In this case, the sealing edge is located radially outside the ring surface and extends in the circumferential direction and radially outwards. In this case, the sealing edge is arranged adjacently on the outside pointing away from the rotor disc alongside the sealing ring. Accordingly, the position of the sealing ring on the side pointing away from the rotor shaft is delimited by the sealing edge. Consequently, a stepped shoulder in which the sealing ring is arranged is created with the radially extending sealing edge and the axially extending ring surface.

A defined position of the sealing ring relative to the sealing edge is achieved through the advantageous design with the sealing edge. Since the sealing ring rests against the conical sealing edge on the outer circumference, movement in a side pointing axially to the rotor shaft is therefore simultaneously limited. A seal between the sealing ring and the sealing edge is simultaneously provided. In particular, rotation of the rotor with the centrifugal forces that occur leads to a pressing of the sealing ring onto the conical sealing surface and the conicity leads simultaneously to a small axial force on the sealing ring and therefore to a pressing of the sealing ring onto the sealing edge.

For the advantageous securing of the position of the sealing ring and of the sealing element, in particular during assembly, it may be advantageous for the outer diameter of the sealing edge to be greater than the outer diameter of the sealing ring.

Assembly is furthermore assisted if in a further advantageous variant there is furthermore a supporting edge present opposite the sealing edge. In this case, the sealing ring is arranged in an axial direction between the sealing edge and the supporting edge. It is particularly advantageous when the sealing ring is received in a manner substantially free from play between the sealing edge and the supporting edge, wherein easy assembly without clamps can be guaranteed.

The height of the supporting edge, i.e. the radial extent, may be differently configured, wherein the alternatives each have different advantages. In a first variant, the outer diameter of the supporting edge is smaller than the outer diameter of the smallest outer diameter of the conical circumferential surface of the sealing ring. In this case, the sealing element with the inner edge portion, particularly during axial displacements, may extend up to the supporting edge. This variant is particularly advantageous if the sealing surface is wider than the sealing ring.

In a second variant, the supporting edge is greater than the smallest outer diameter of the sealing ring, but smaller than the outer diameter of the sealing edge. In this case, the inner edge portion is likewise arranged between the sealing edge and the supporting edge, this going hand in hand with the width of the sealing surface having to be smaller than the width of the sealing ring, so that the necessary axial displaceability can be guaranteed. This design may, where appropriate, make assembly of the sealing elements easier.

Consequently, a defined position of the sealing ring in the axial direction is achieved by the sealing edge and the supporting edge, and the position of the sealing ring in the radial direction is delimited on the side pointing to the rotor shaft by the ring surface and on the side pointing radially outwards by the sealing surface of the sealing element. This encourages a sliding of the circumferential surface of the sealing ring relative to the sealing surface, particularly during axial displacements of the sealing ring relative to the sealing element, without any tilting of the sealing ring (due to frictional forces, for example) being able to take place.

The sealing element according to the invention can be particularly advantageously used when the rotor encloses a rotor component adjacent to the rotor disc. The rotor component may be a further rotor disc provided with rotor blades or another rotor disc without rotor blades or a rotor component surrounding the rotor shaft in a ring-shaped manner, which rotor component may be of integral or segmented design in this case. The rotor component is at least mounted directly adjacent to the rotor disc. The rotor component in this case has a circumferential sealing portion which is arranged adjacent to the inner edge portion of the sealing element. With this arrangement of the inner edge portion of the sealing element in the case of the sealing portion of the rotor component, a sealing gap which has to be sealed is defined between these two components. For this purpose, the sealing portion encloses the sealing edge and the ring surface of the stepped shoulder, which together delimit the position of the sealing ring opposite the sealing surface of the sealing element.

A limited axial displacement of the rotor component relative to the rotor disc can be facilitated in a particularly advantageous manner by the embodiment according to the invention with the separate rotor component mounted on the rotor disc. These relative displacements may, on the one hand, be used to balance tolerances and also in a particularly advantageous manner to allow different thermal expansions to be balanced. In this case, there is a relative displacement of the sealing portion on the rotor component relative to the fastening projection on the rotor disc and therefore relative to the inner edge portion of the sealing element mounted on the rotor disc.

With regard to the layout of the axial clearance, taking account of the thermal expansions of the components which occur, it is advantageous for the sealing edge of the rotor component or the sealing portion of the rotor component and therefore, at the same time, the sealing ring to be axially displaceable by at least 0.2 times the width of the smaller sliding surface of the sealing surface of the sealing element and the circumferential surface of the sealing ring relative to the inner edge portion. In the first embodiment with a smaller width of the sealing surface in the axial direction relative to the width of the sealing ring, the advantageous axial displaceability of the sealing edge relative to the sealing surface is therefore at least 0.2 times the width of the sealing surface. By contrast, in the second embodiment with the smaller width of the sealing ring relative to the width of the sealing surface in the axial direction, the axial displaceability of the sealing edge relative to the sealing surface is at least 0.2 times the width of the sealing ring. It is particularly advantageous, however, for there to be an axial displaceability of at least 0.5 times the width of the sealing surface (in the first embodiment) or of the sealing ring (in the second embodiment).

Irrespective of the embodiment of the rotor according to the invention as previously described or an advantageous design thereof, an advantageous seal and, at the same time, axial displaceability can be achieved with a virtually reversed form of the sealing ring. This second embodiment of a rotor according to the invention has the following form in this case.

In the same way as with the previous first embodiment according to the invention, the second embodiment of a rotor according to the invention comprises a rotor disc as previously described. A rotor component is mounted on the rotor disc in a similar manner to the first advantageous embodiment, which rotor disc has limited axial displaceability and has a sealing portion. The rotor blade retaining groves in the rotor disc are similarly covered by a plurality of sealing elements arranged distributed over the circumference, which sealing elements are each fastened with retaining projections to the fastening projections of the rotor disc. In the same way as with the first embodiment according to the invention, the sealing elements have an outer edge portion on the radially outwardly pointing side and an inner edge portion on the side pointing to the rotor shaft and an inner side on the side pointing to the rotor shaft and an outer side opposite pointing away from the rotor disc. Similarly, a sealing gap to be sealed between the inner edge portion of the sealing elements and the sealing portion of the rotor component is observed.

In the second embodiment according to the invention which is reversed in respect of the first embodiment according to the invention, the sealing portion of the rotor component has a conical sealing surface on the radially outwardly pointing side, wherein the inner edge portion of the respective sealing element has a sealing edge extending in the circumferential direction and radially inwardly and a circumferential ring surface which extends axially. Likewise, a one-piece or multi-piece sealing ring is arranged between the inner edge portion of the sealing element and the sealing portion of the rotor component, wherein said sealing ring is reversed by comparison with the previous embodiment. Consequently, the sealing ring lies on the radially outwardly pointing side on the cylindrical ring surface and is axially limited by the sealing edge of the sealing element in the position, while on the other hand the sealing ring on the side pointing towards the rotor shaft lies on the sealing portion of the rotor component on the conical sealing surface.

The fact that a sealing ring is arranged in the receiving space between the sealing portion and the inner edge portion is of substantial advantage to the rotor according to the invention, which sealing ring brings about a sealing action, on the one hand, by bearing against the sealing portion and, on the other hand, by bearing against the inner edge portion. In this case, the sealing ring can move radially outwardly to a limited degree (through elongation and/or on account of a division), wherein axial displaceability of the inner edge portion relative to the sealing portion is possible. The inclined sealing surface on one side secures the bearing of the sealing ring against the sealing surface in this case.

BRIEF DESCRIPTION OF THE DRAWINGS

In the following figures, exemplary embodiments for a rotor with sealing element and sealing ring are sketched. In the figures.

DETAILED DESCRIPTION OF INVENTION

Figure 1:
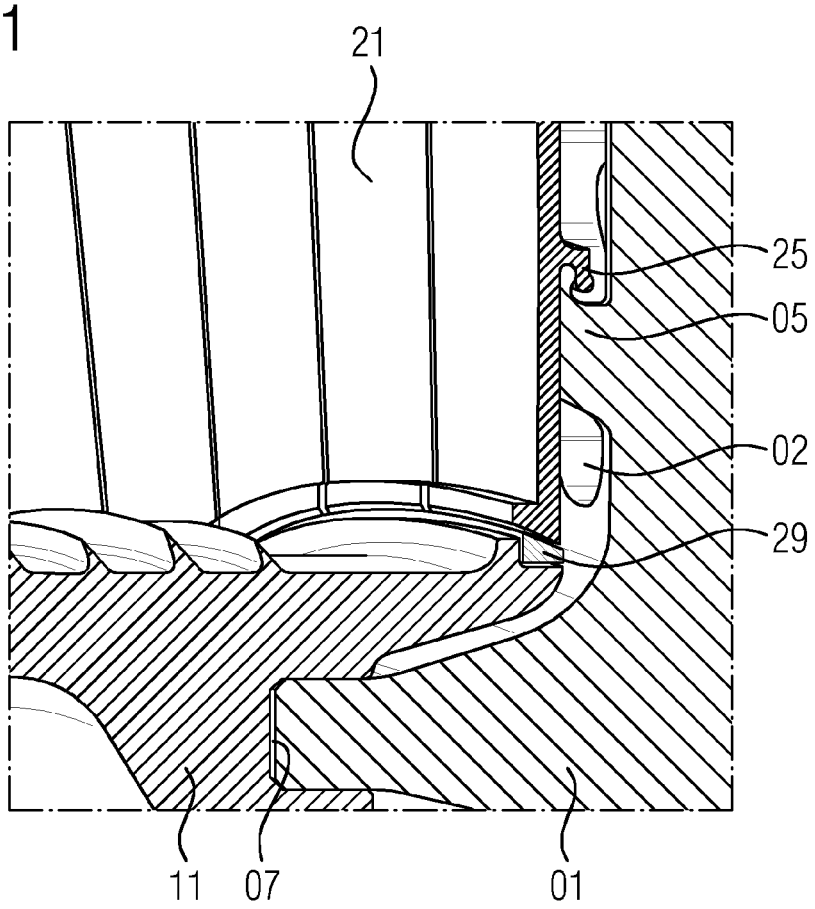
FIG. 1 shows a first exemplary embodiment as a perspective section.

A first exemplary embodiment for a rotor according to the invention is sketched in FIG. 1. A rotor disc 01 can be identified which 01 comprises rotor blade retaining grooves 02 arranged distributed around the circumference. Rotor blades are fastened as intended in said retaining grooves 02. Furthermore, the rotor disc 01 has a fastening projection 05 which 05 is configured in the form of a radially outwardly pointing hook.

Adjacent to the rotor disc 01 is located a rotor component 11 fastened to said rotor disc 01, wherein a gap 07 is located between the components 01, 11. In the correct assembly of the rotor disc 01 and rotor component 11, the two components 01, 11 can be displaced about a small path relative to one another. This is used, in particular, to balance different thermal expansions in the rotor with the rotor disc 01 and the rotor component 11.

Also to be recognized is the arrangement of the sealing elements 21 which 21 are fastened to the rotor disc 01 distributed over the circumference in front of the rotor blade grooves 02. For this purpose, the sealing elements 21 have a retaining projection 25 which 25 is configured in this exemplary embodiment in the form of a hook pointing radially to the rotor shaft. The axial fixing of the sealing elements 21 is brought about by the interlocking of the fastening projection 05 and the retaining projection 25. Not shown is the axial fixing which is customarily furthermore present of the sealing elements 21 with a radially outwardly pointing edge portion in a ring segment groove of the rotor blades fastened in the rotor disc 01.

Figure 2:
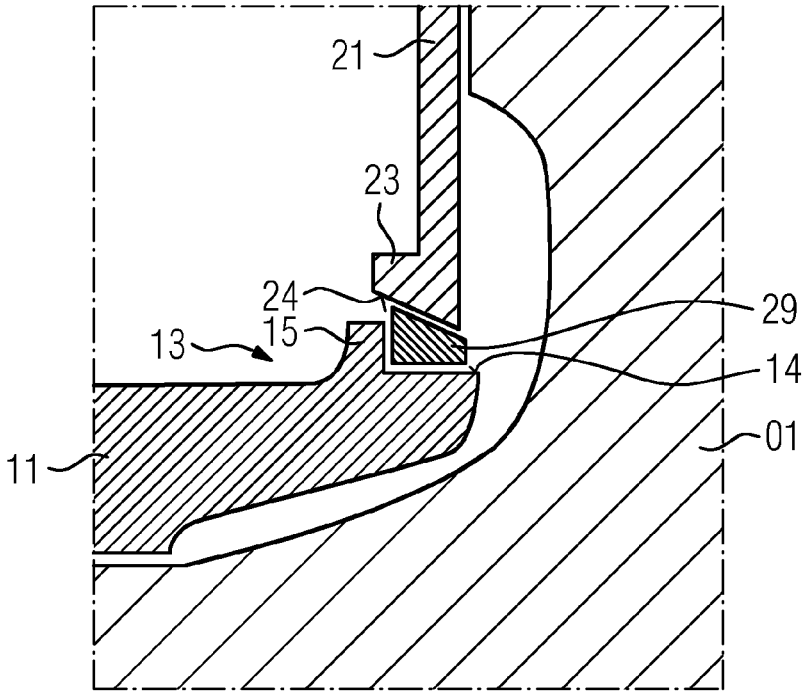
FIG. 2 shows a sectional representation of the embodiment in FIG. 1 in the region of the sealing ring.

The seal between the sealing elements 21 and the rotor component 11 is depicted in detail in FIG. 2. Likewise, the rotor disc 01 with the adjacently arranged rotor component 11 can likewise be identified. There is a sealing element 21 in front of the front side of the rotor disc 01. In this case, the sealing element 21 bears against a sealing portion 13 of the rotor component 11 with an inner edge portion 23. A sealing ring 29 is used to provide a seal between the two components 11, 21. In order to receive the sealing ring 29, the sealing portion 13 has a shoulder. The shoulder is formed by a sealing edge 15 on the side pointing away from the rotor disc 01 and by a ring surface 14 on the side pointing to the rotor shaft. On the opposite side, the inner edge portion 23 of the sealing element 21 has a conical sealing surface 24. The conical sealing surface 24 in this case is oriented in such a manner that the distance to the rotor shaft pointing away from the sealing edge 15 decreases as the rotor disc draws nearer. Consequently, a limited receiving space for the arrangement of the sealing ring 29 is formed. To this extent, the position of the sealing ring 29 is limited on the side pointing to the rotor shaft of the ring surface 14 of the sealing portion 13 and on the side pointing away from the rotor shaft of the sealing edge 15 of the sealing portion 13 and on the radially outwardly pointing side and the side pointing in the direction of the rotor disc 01 of the sealing surface 24 on the inner edge portion 23 of the sealing element 21.

It is provided in this case that the sealing ring 29 can move to a limited degree within the receiving space, but when the rotor rotates there is a bearing of the sealing ring 29 against the conical sealing surface 24 and the sealing edge 15 and a seal between the sealing element 21 and the rotor component 11 is therefore provided.

Figure 3:
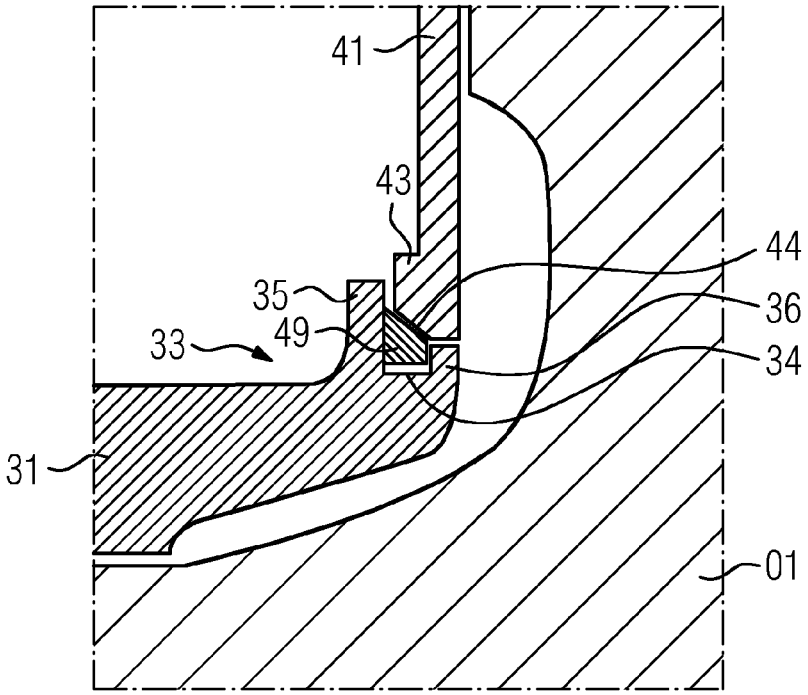
FIG. 3 shows a second exemplary embodiment corresponding to the depiction in FIG. 2.

A further exemplary embodiment of a rotor according to the invention with the novel seal between the sealing elements 41 and a rotor component 31 is sketched in FIG. 3. What can be seen initially is the rotor disc 01 on which 01 the rotor component 31 is arranged adjacently. Sealing elements 41 are in turn located in front of a front side of the rotor disc 01. A gap is formed between the sealing elements 41 and the rotor component 31, which gap should be sealed in the best manner possible. A possible relative axial displacement of the rotor component 31 relative to the rotor disc 01 and therefore to the sealing elements 41 is in turn made possible by the particular seal between the inner edge portion 43 of the sealing elements 41 and the sealing portion 33 of the rotor component 31. For this purpose, the sealing elements 41 are provided with a conical sealing surface 44 in a similar manner to the embodiment in FIG. 2. A sealing ring 49 rests against the sealing surface 44, said sealing ring 49 likewise having a conical form on the radially outwardly pointing side.

By contrast, the sealing portion 33 has a circumferential groove which is delimited in an axial direction on the outside of a sealing edge 35 pointing away from the rotor disc 01 and on the inside of a supporting edge 36 pointing to the rotor disc 01. In this case, a sealing edge 35 extends pointing radially outwardly beyond the sealing ring 49. To this extent, the sealing edge 35 not only forms the bearing surface for the sealing ring 49, but it likewise represents a limit for the movement space of the inner edge portion 43 of the sealing element 41.

However, the likewise radially outwardly extending supporting edge 36 has a substantially smaller outer radius and the sealing ring 49 projects beyond it. Furthermore, the inner edge portion 43 is located radially outside the supporting edge 36 and to this extent it can move unhindered in an axial direction beyond the supporting edge 36. The supporting edge 36 in this case is particularly used to secure the position of the sealing ring 49 during assembly. During rotation of the rotor, the tilted bearing surface of the sealing ring 49 on the tilted sealing surface 44 of the inner edge portion 43 causes a displacement of the sealing ring 49 facing the sealing edge 35, so that the supporting edge 36 has no function during rotation of the rotor. The position of the sealing ring 49 is therefore delimited during rotation of the rotor by the sealing edge 35 and the sealing surface 44 of the inner edge portion 43, both in the radial direction and in the axial direction.

The position of the sealing ring 49 when the rotor is stationary in the direction pointing towards the rotor shaft is delimited by the groove base with a ring surface 34 on the sealing portion 33 of the rotor component 31.

Figure 4:
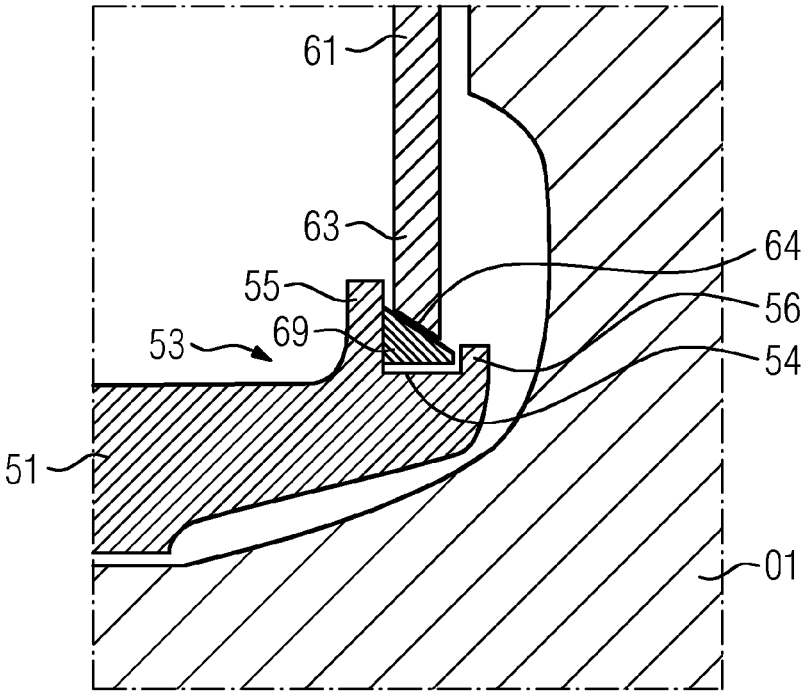
FIG. 4 shows a third exemplary embodiment corresponding to the depiction in FIG. 2.

An embodiment of a rotor similar to the previous example is sketched in FIG. 4. The rotor disc 01 with the adjacent rotor component 51 can in turn be identified, said rotor component also having a sealing portion 53 on the side pointing to the rotor disc 01. In front of the front side of the rotor disc 01 is located the sealing element 61 with the inner edge portion 63. As previously, a conical sealing surface 64 is arranged on the inner edge portion 63. Correspondingly, the sealing portion 53 forms a sealing edge 55 and a supporting edge 56 and has a ring surface 54. Unlike in the case of the previous example, it is provided, however, that the sealing ring 69 has a greater width compared with the sealing surface 64 and, to this extent, the inner edge portion 63 of the sealing element 61 is arranged between the sealing edge 55 and the supporting edge 56 in an axially displaceable manner.

Figure 5:
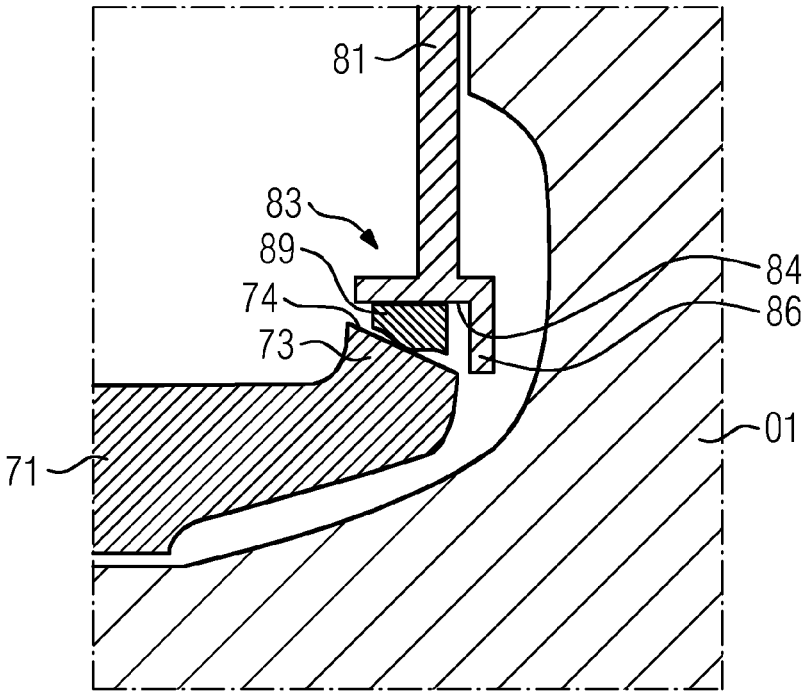
FIG. 5 shows a fourth exemplary embodiment with the sealing ring reversed.

An exemplary embodiment for the second embodiment according to the invention of a rotor for creating a seal between sealing elements 81 and a rotor component 71 is sketched in FIG. 5 to correspond to the depiction from FIG. 2. In turn, the rotor disc 01 with the adjacent rotor component 71 can be identified. Sealing elements 81 are likewise in turn located in front of the front side of the rotor disc 01. In this exemplary embodiment, the rotor component 71 has a sealing portion 73 on the side pointing to the sealing element 81, which sealing portion 73 is provided with a conical sealing surface 74. In contrast, the sealing element 81 has on the inner edge portion 83 a shoulder delimited by a sealing edge 86 arranged on the side pointing to the rotor disc 01 and a ring surface 84. Consequently, a receiving space delimited by the sealing portion 73 and inner edge portion 83 is in turn created, in which the sealing ring 89 is arranged in a similar manner to the previous exemplary embodiment. In the same way, the sealing ring 89 can move in a limited manner in the receiving space, wherein a seal is created during operation. On the one hand, this is brought about by the rotation of the rotor, as a result of which a secure bearing of the sealing ring 89 on the ring surface 84 takes place. Cooling air with a higher pressure than on the opposite outer side of the sealing element 81 customarily flows through the space between the rotor disc 01 and the inner side of the sealing element 81. This greater pressure of the cooling air further causes a reliable bearing of the sealing ring 89 on the conical sealing surface 74.

The invention claimed is:

1. A rotor, comprising:

at least one rotor disc which has a plurality of rotor blade retaining grooves arranged distributed around a circumference and a plurality of fastening projections arranged axially in front of a front side between the rotor blade retaining grooves, and a plurality of sealing elements arranged distributed over the circumference which are fastened by retaining projections to the fastening projections, wherein each sealing element extends at least in a circumferential direction and in a radial direction and forms at least sectionally a portion of a ring-shaped disc and a radially outwardly pointing outer edge portion and an inner edge portion pointing to a rotor shaft and an inner side pointing to the rotor disc and an opposite outer side and each retaining projection arranged on the inner side, wherein the inner edge portion is conical in design on an underside pointing to the rotor shaft, wherein each retaining projection is configured to fasten each sealing element to the rotor disc, and wherein the conical underside forms a sealing surface, wherein a distance between the sealing surface and the rotor shaft on the inner side is smaller than on the outer side.

2. The rotor as claimed in claim 1, further comprising:

a plurality of rotor blades which are each fastened with a blade root in the blade retaining grooves and each has a blade platform adjacent to the blade root and enclosing the rotor disc sectionally, wherein in the blade platform in a portion projecting beyond a front side of the rotor disc, a ring segment groove is arranged running in the circumferential direction and opening to the rotor shaft, and wherein the outer edge portions of the sealing elements are mounted at least axially in the ring segment groove.

3. The rotor as claimed in claim 1, wherein each retaining projection is formed by a hook pointing to the rotor shaft and each fastening projection is formed by a radially outwardly pointing hook, wherein transmission of centrifugal forces takes place via the outer edge portions; or wherein each retaining projection is formed by a radially outwardly pointing hook and each fastening projection is formed by a hook pointing to the rotor shaft, wherein the transmission of centrifugal forces takes place via each retaining projection; or wherein each retaining projection has a T-shaped form and each fastening projection has a C-shaped form; or wherein each retaining projection has a C-shaped form and each fastening projection has a T-shaped form.

4. The rotor as claimed in claim 1, further comprising:

a one-piece or multi-piece sealing ring which bears against the sealing elements on the inner edge portions and is a piston ring.

5. The rotor as claimed in claim 4, wherein a width of the sealing surface in the axial direction is between 0.6 times and 0.9 times a width of the sealing ring; or wherein a width of the sealing ring is between 0.6 times and 0.9 times a width of the sealing surface in the axial direction.

6. The rotor as claimed in claim 5, wherein the width of the sealing surface in the axial direction is between 0.7 times and 0.8 times the width of the sealing ring; or wherein the width of the sealing ring is between 0.7 times and 0.8 times the width of the sealing surface in the axial direction.

7. The rotor as claimed in claim 4, wherein a center of an area of a cross section through the sealing ring is located in the sealing surface in the axial direction.

8. The rotor as claimed in claim 4, further comprising:

a circumferential ring surface which limits the position of the sealing ring toward the rotor shaft, and a sealing edge which limits the position of the sealing ring on the outer side.

9. The rotor as claimed in claim 8, wherein an outer diameter of the sealing edge is greater than an outer diameter of the sealing ring.

10. The rotor as claimed in claim 8, further comprising:

a supporting edge which limits the position of the sealing ring on the inner side in a play-free manner.

11. The rotor as claimed in claim 10, wherein an outer diameter of the supporting edge is smaller than an outer diameter of the sealing edge and/or greater than the smallest outer diameter of the sealing ring.

12. The rotor as claimed in claim 8, further comprising:

a rotor component mounted on the rotor disc, wherein the rotor component forms the sealing edge and the ring surface, wherein the sealing edge has limited axial displaceability relative to the fastening projections at least on account of thermal expansions.

13. The rotor as claimed in claim 12, wherein the sealing edge is axially displaceable in the axial direction by at least 0.2 times a width of the sealing ring with a greater width of the sealing surface, or wherein the sealing edge is axially displaceable by at least 0.2 times a width of the sealing surface in the axial direction with a greater width of the sealing ring.

14. The rotor as claimed in claim 13, wherein the sealing edge is axially displaceable in the axial direction by at least 0.5 times the width of the sealing ring with a greater width of the sealing surface, or wherein the sealing edge is axially displaceable by at least 0.5 times the width of the sealing surface in the axial direction with a greater width of the sealing ring.

15. The rotor as claimed in claim 1, wherein the rotor comprises a gas turbine rotor.

16. A rotor, comprising:

at least one rotor disc which has a plurality of rotor blade retaining grooves arranged distributed around its circumference and a plurality of fastening projections arranged axially in front of a front side between the rotor blade retaining grooves, a rotor component which is mounted on the rotor disc and has at least limited axial displaceability and has a sealing portion, and a plurality of sealing elements arranged distributed over the circumference, which extend substantially in the circumferential direction and in the radial direction and form a portion of a ring-shaped disc and a radially outwardly pointing outer edge portion and an inner edge portion pointing to the rotor shaft and an inner side pointing to the rotor disc and an opposite outer side and a retaining projection arranged on the inner side, wherein the sealing elements are fastened with the retaining projections to the fastening projections of the rotor disc, wherein the inner edge portion of the sealing elements is arranged adjacent to the sealing portion of the rotor component, and wherein the sealing portion has a conical sealing surface on its radially outwardly pointing side and the inner edge portion of the sealing elements has a sealing edge extending in the circumferential direction and radially inwardly and a circumferential ring surface which extends axially, wherein a one-piece or multi-piece sealing ring is arranged between the sealing surface and the ring surface and the sealing edge.

17. The rotor as claimed in claim 16, wherein the rotor comprises a gas turbine rotor.

* * * * *